US011470968B1

(12) United States Patent
Sha et al.

(10) Patent No.: US 11,470,968 B1
(45) Date of Patent: Oct. 18, 2022

(54) FREESTANDING SINGLE-MOTOR-DRIVEN MECHANICAL EXTENSION DEVICE

(71) Applicant: Jianbo Sha, Taizhou (CN)

(72) Inventors: Jianbo Sha, Taizhou (CN); Guoli Zou, Taizhou (CN); Wei Lu, Taizhou (CN)

(73) Assignee: Jianbo Sha, Taizhou (CN)

( * ) Notice: Subject to any disclaimer, the term of this patent is extended or adjusted under 35 U.S.C. 154(b) by 0 days.

(21) Appl. No.: 17/361,349

(22) Filed: Jun. 29, 2021

(30) Foreign Application Priority Data

May 26, 2021 (CN) ..... 202110578541.2

(51) Int. Cl.
*A47C 1/034* (2006.01)

(52) U.S. Cl.
CPC ..... *A47C 1/034* (2013.01)

(58) Field of Classification Search
CPC . A47C 1/0355; A47C 1/03211; A47C 1/0345; A47C 1/035; A47C 17/1756
USPC ..... 297/83–85
See application file for complete search history.

(56) References Cited

U.S. PATENT DOCUMENTS 8,419,122 B2 * 4/2013 Lawson ..... A47C 1/035 297/259.2
10,383,442 B2 * 8/2019 Lawson ..... A47C 1/0355
11,140,990 B2 * 10/2021 Sun ..... A47C 1/024

FOREIGN PATENT DOCUMENTS

CN 112545236 A 3/2021

* cited by examiner

*Primary Examiner* — Sarah B McPartlin
(74) *Attorney, Agent, or Firm* — Bayramoglu Law Offices LLC

(57) ABSTRACT

A freestanding single-motor-driven mechanical extension device includes a base. Left and right sides of the base are respectively pivotally connected to an extension assembly. The extension assembly includes a base plate linkage mechanism, a leg extension mechanism and a backrest mechanism. The base plate linkage mechanism includes a front mounting member and a rear mounting member. One end of the front mounting member is pivotally connected to the front part of the base, and the other end of the front mounting member is pivotally connected to a first front rotating member. The other end of the first front rotating member is pivotally connected to a mounting side plate. The middle part of the front mounting member is pivotally connected to a second front rotating member. The other end of the second front rotating member is pivotally connected to the middle part of the mounting side plate.

7 Claims, 4 Drawing Sheets

FREESTANDING SINGLE-MOTOR-DRIVEN MECHANICAL EXTENSION DEVICE

CROSS REFERENCE TO THE RELATED APPLICATIONS

This application is based upon and claims priority to Chinese Patent Application No. 202110578541.2, filed on May 26, 2021, the entire contents of which are incorporated herein by reference.

TECHNICAL FIELD

The present invention relates to the field of home furnishing manufacturing, and more particularly, to a freestanding single-motor-driven mechanical extension device.

BACKGROUND

Chinese patent (application number: CN202011581240.7) discloses a new motor-driven mechanical extension device (as shown in its FIG. 7). Specifically, one end of the second front rotating member is pivotally connected to the front mounting member, and the other end of the second front rotating member is pivotally connected to the side link member. The second front rotating member has no restriction on the mounting side plate, so that when the extension device is switched from the television (TV)-watching posture to the lying posture, the front part of the mounting side plate rises excessively fast and unstably, which affects the user experience.

SUMMARY

In order to overcome the shortcomings in the prior art, an objective of the present invention is to provide a freestanding single-motor-driven mechanical extension device, which has stable motion and improves the user experience.

In order to achieve the above objective, the present invention adopts the following technical solutions.

A freestanding single-motor-driven mechanical extension device includes a base. Left and right sides of the base are respectively pivotally connected to an extension assembly. The extension assembly includes a base plate linkage mechanism pivotally connected to the base. The front part of the base plate linkage mechanism is pivotally connected to a leg extension mechanism, and the rear part of the base plate linkage mechanism is pivotally connected to a backrest mechanism. The base plate linkage mechanism includes a front mounting member and a rear mounting member. One end of the front mounting member is pivotally connected to the front part of the base, and the other end of the front mounting member is pivotally connected to a first front rotating member. The other end of the first front rotating member is pivotally connected to a mounting side plate. The middle part of the front mounting member is pivotally connected to a second front rotating member. The other end of the second front rotating member is pivotally connected to the middle part of the mounting side plate. One end of the rear mounting member is pivotally connected to the rear part of the base, and the other end of the rear mounting member is pivotally connected to a rear rotating member. The other end of the rear rotating member is pivotally connected to the rear part of the mounting side plate. The middle part of the rear rotating member is pivotally connected to a side link member. The other end of the side link member is pivotally connected to the first front rotating member.

Preferably, the base includes a bottom front rod. Two ends of the bottom front rod are respectively fixedly connected to a bottom side rod. The bottom side rod is pivotally connected to the extension assembly. The other end of the bottom side rod is fixedly connected to a bottom rear rod. The middle part of the bottom rear rod is hinged with a push rod motor. A telescopic end of the push rod motor is hinged with a drive rod. The drive rod is configured to drive the leg extension mechanism to move.

Preferably, a backing plate is provided below the bottom rear rod, and the backing plate is fixedly connected to the bottom side rods on both sides.

Preferably, the leg extension mechanism includes a footrest mounting plate. The footrest mounting plate is pivotally connected to a first leg link rod and a second leg link rod. The other end of the first leg link rod is pivotally connected to a third leg link rod. The middle part of the third leg link rod is fixedly connected to the drive rod. The other end of the second leg link rod is pivotally connected to a fourth leg link rod. The other end of the fourth leg link rod and the other end of the third leg link rod are simultaneously pivotally connected to the front part of the mounting side plate. The middle part of the second leg link rod is pivotally connected to the middle part of the third leg link rod.

Preferably, the backrest mechanism includes a backrest mounting plate pivotally connected to the mounting side plate. The other end of the backrest mounting plate is pivotally connected to a rear support link rod. The other end of the rear support link rod is pivotally connected to the rear rotating member.

Preferably, a front support member is fixedly connected between the front mounting members on both sides. A rear support member is fixedly connected between the rear mounting members on both sides. The rear support member is provided with a notch for avoiding the push rod motor.

Preferably, a protective member is fixedly connected to the rear part of the mounting side plate.

Compared with the prior art, the present invention has the following advantages:

1. When the extension device is switched from a TV-watching posture to a lying posture, the second front rotating member restricts the mounting side plate, so that the front part of the mounting side plate can be raised smoothly, thereby improving the user experience.

2. The push rod motor is hinged with the bottom rear rod, which increases the angle between the power unit and the ground, and ensures that the movement direction of the footrest mounting plate is in the axial direction of the telescopic end of the push rod motor. Thus, the footrest mounting plate is more stable and smoother when expanded or contracted. In addition, the drive rod hinged between the rear rotating members in the prior art is omitted, which shortens the assembly process, improves work efficiency and saves cost.

3. The rear support member is provided with a notch to avoid the movement interference between the push rod motor and the rear support member.

In the figures: 1. base; 11. bottom front rod; 12. bottom side rod; 13. bottom rear rod; 14. backing plate; 2. extension assembly; 21. base plate linkage mechanism; 211. front mounting member; 212. rear mounting member; 213. first front rotating member; 214. mounting side plate; 215. protective member; 216. second front rotating member; 217. rear rotating member; 218. side link member; 22. leg extension mechanism; 221. footrest mounting plate; 222. first leg link rod; 223. third leg link rod; 224. second leg link rod; 225. fourth leg link rod; 23. backrest mechanism; 231. backrest mounting plate; 232. support link rod; 241. first shaft; 242. second shaft; 243. third shaft; 244. fourth shaft; 245. fifth shaft; 246. sixth shaft; 247. seventh shaft; 248. eighth shaft; 249. ninth shaft; 250. tenth shaft; 251. eleventh shaft; 252. twelfth shaft; 253. thirteenth shaft; 254. fourteenth shaft; 255. fifteenth shaft; 256. sixteenth shaft; 257. seventeenth shaft; 258. eighteenth shaft; 259. nineteenth shaft; 260. twentieth shaft; 261. first limit pin; 262. second limit pin; 263. third limit pin; 264. fourth limit pin; 265. fifth limit pin; 271. first limit surface; 272. second limit surface; 273. third limit surface; 274. fourth limit surface; 275. fifth limit surface; 276. sixth limit surface; 277. seventh limit surface; 3. push rod motor; 4. drive rod; 5. front support member; 6. rear support member; and 61. notch.

DETAILED DESCRIPTION OF THE EMBODIMENTS

The present invention is further described below with reference to the drawings and embodiments. It should be understood that these embodiments are only intended to illustrate the present invention, rather than to limit the scope of the present invention. Modifications of equivalent forms or similar structures made to the present invention by those skilled in the art after reading the present invention shall fall within the scope defined by the appended claims of the present invention.

Figure 1:
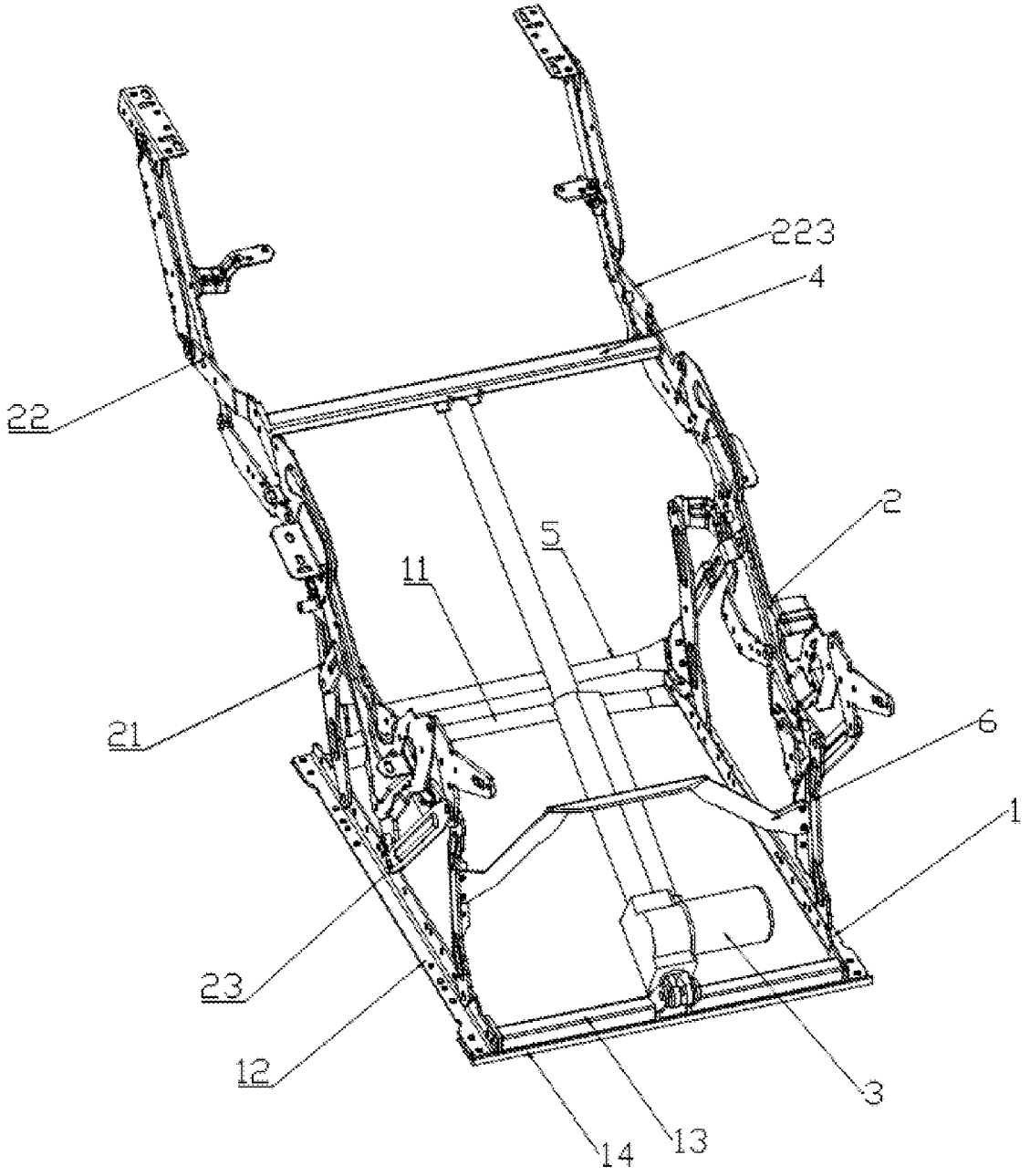
FIG. 1 is a schematic view of the structure of a freestanding single-motor-driven mechanical extension device according to the present invention.
Figure 2:
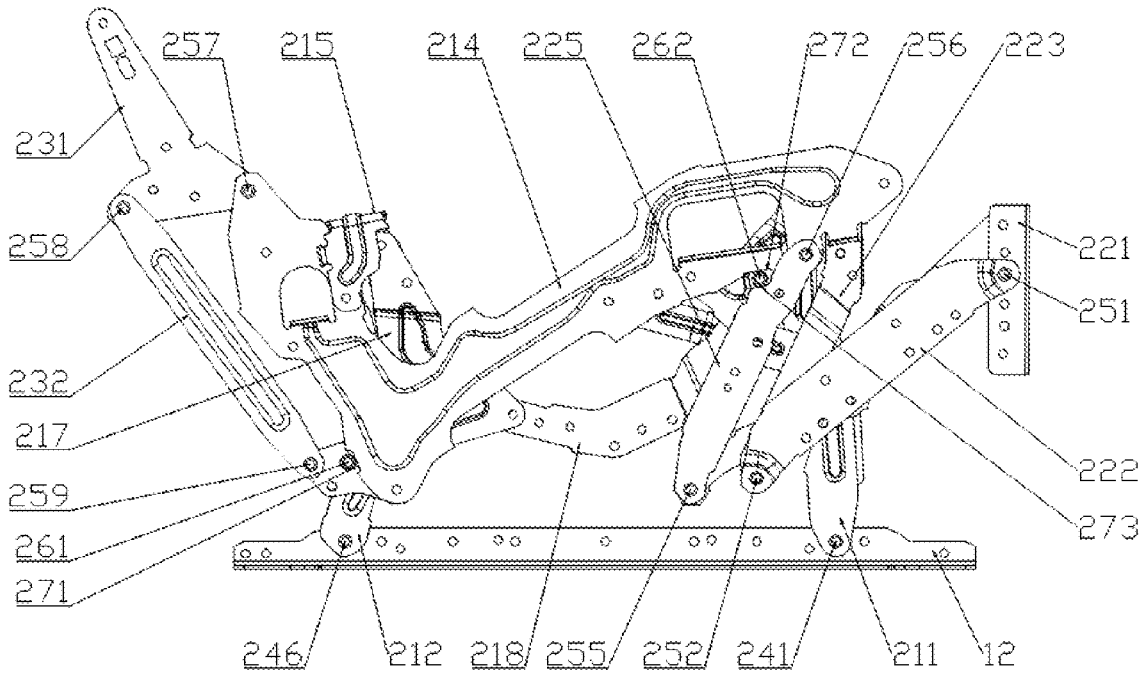
FIG. 2 is a front view of the freestanding single-motor-driven mechanical extension device in a sitting posture according to the present invention.
Figure 3:
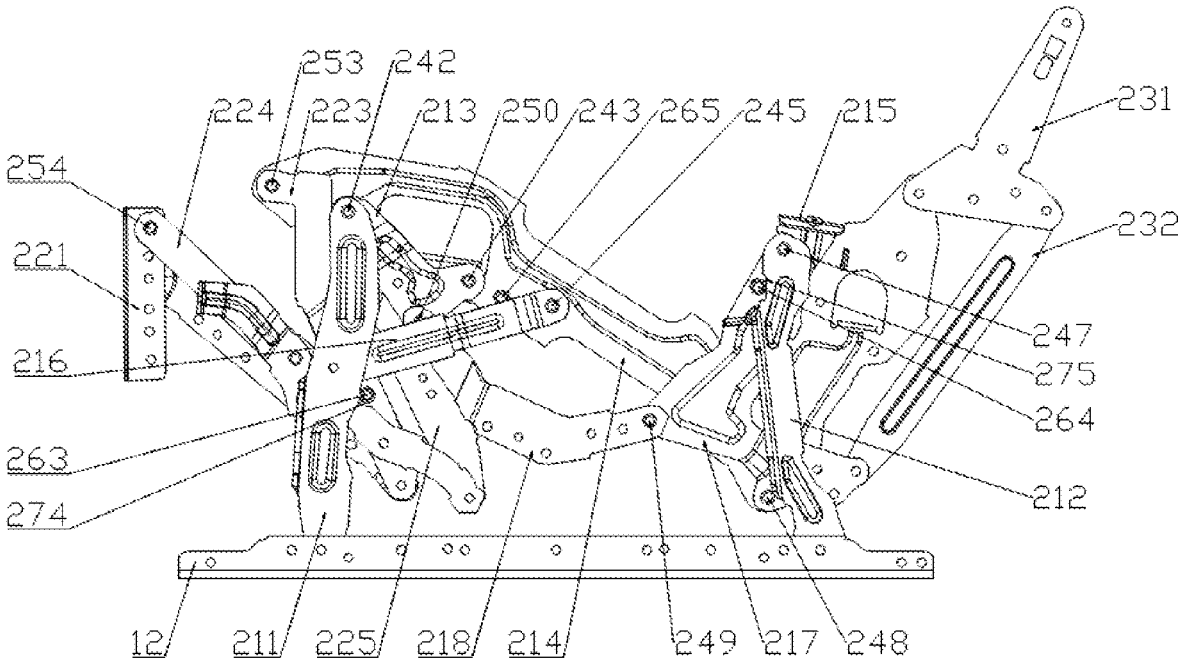
FIG. 3 is a rear view of the freestanding single-motor-driven mechanical extension device in a sitting posture according to the present invention.
Figure 4:
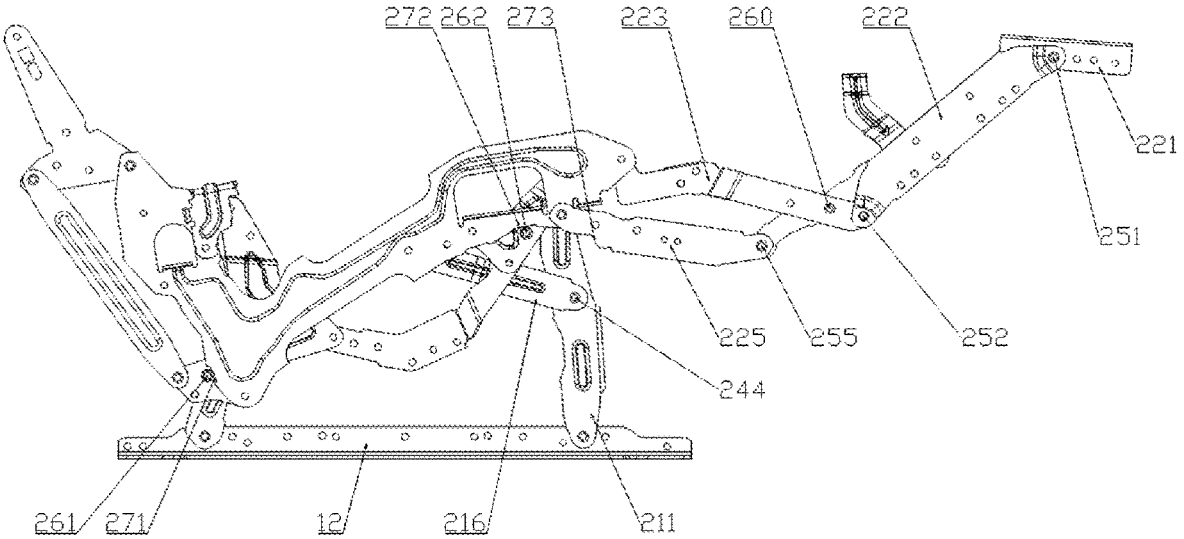
FIG. 4 is a front view of the freestanding single-motor-driven mechanical extension device in a TV-watching posture according to the present invention.
Figure 5:
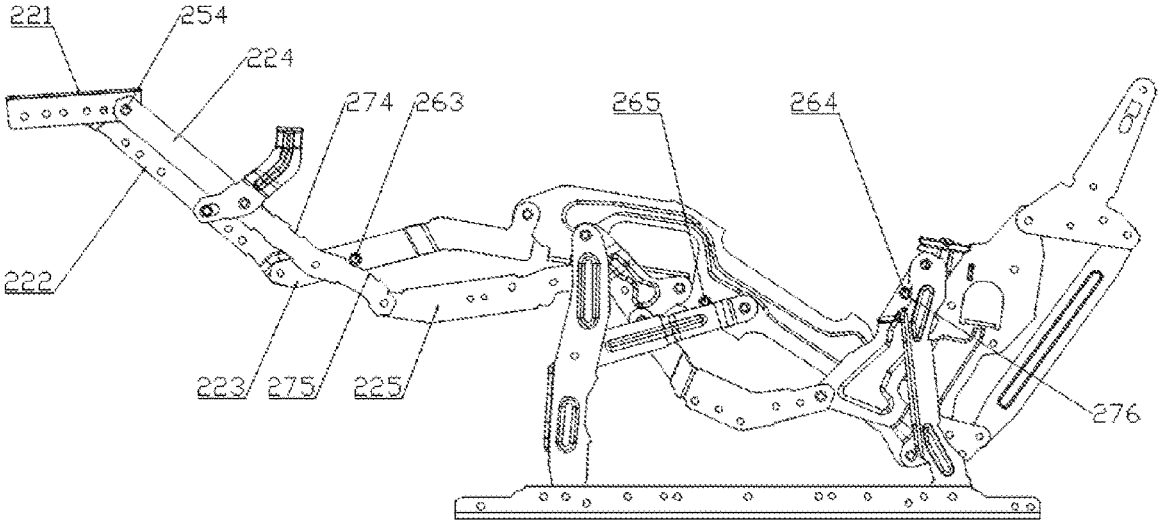
FIG. 5 is a rear view of the freestanding single-motor-driven mechanical extension device in a TV-watching posture according to the present invention.
Figure 6:
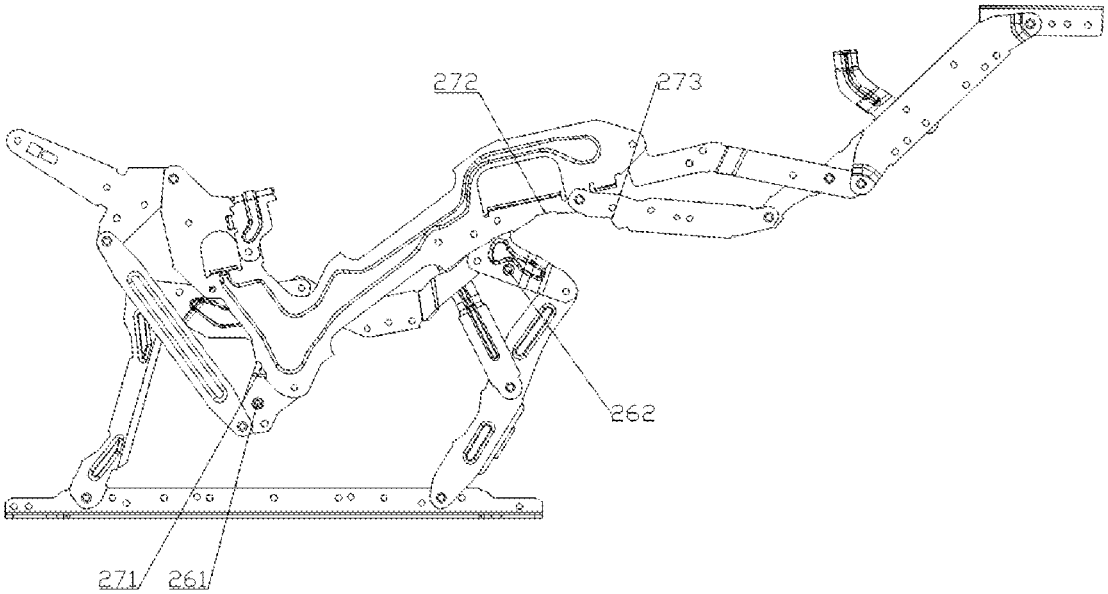
FIG. 6 is a front view of the freestanding single-motor-driven mechanical extension device in a lying posture according to the present invention.
Figure 7:
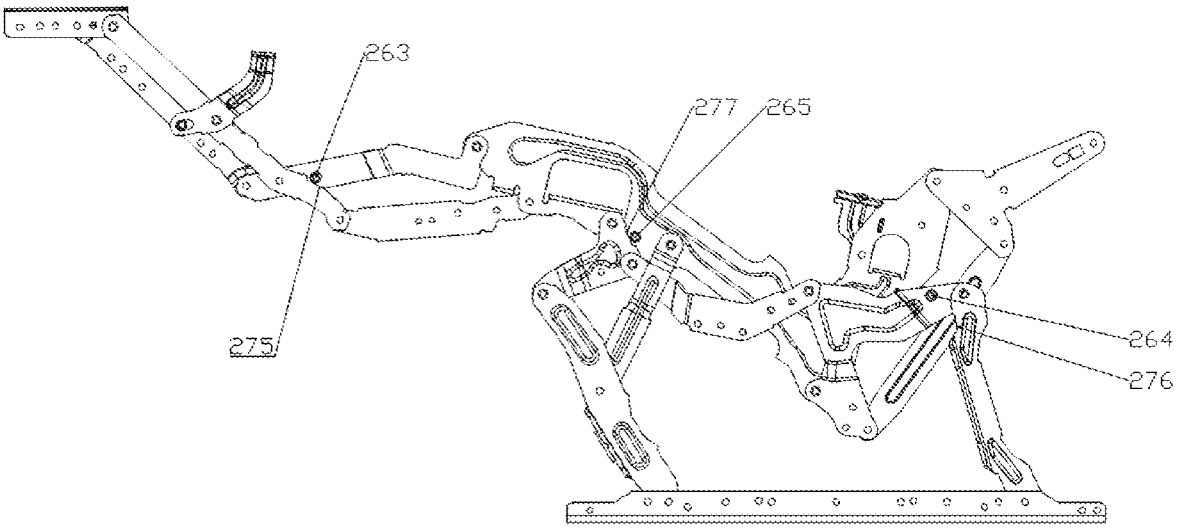
FIG. 7 is a rear view of the freestanding single-motor-driven mechanical extension device in a lying posture according to the present invention.
Figure 8:
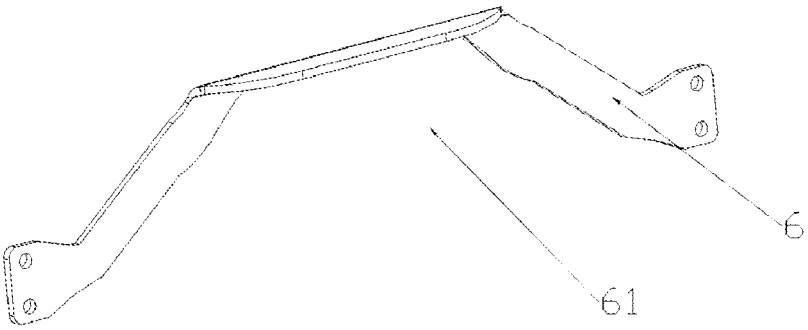
FIG. 8 is a schematic view of the structure of a rear support member.

As shown in FIGS. 1 to 8, a freestanding single-motor-driven mechanical extension device includes the base 1. The base includes the bottom front rod 11. Two ends of the bottom front rod are respectively fixedly connected to the bottom side rod 12. The bottom side rod is pivotally connected to the extension assembly 2. The extension assembly includes the base plate linkage mechanism 21. The front part of the base plate linkage mechanism is pivotally connected to the leg extension mechanism 22, and the rear part of the base plate linkage mechanism is pivotally connected to the backrest mechanism 23. The base plate linkage mechanism includes the front mounting member 211 and the rear mounting member 212. The lower end of the front mounting member is pivotally connected to the front part of the bottom side rod through the first shaft 241, and the upper end of the front mounting member is pivotally connected to the first front rotating member 213 through the second shaft 242. The first front rotating member is pivotally connected to the mounting side plate 214 through the third shaft 243. The protective member 215 is fixedly connected to the rear part of the mounting side plate. The middle part of the front mounting member is pivotally connected to the second front rotating member 216 through the fourth shaft 244. The second front rotating member is pivotally connected to the middle part of the mounting side plate through the fifth shaft 245. The lower end of the rear mounting member is pivotally connected to the rear part of the bottom side rod through the sixth shaft 246, and the upper end of the rear mounting member is pivotally connected to the rear rotating member 217 through the seventh shaft 247. The rear rotating member is pivotally connected to the rear part of the mounting side plate through the eighth shaft 248. The middle part of the rear rotating member is pivotally connected to the side link member 218 through the ninth shaft 249. The front end of the side link member is pivotally connected to the first front rotating member through the tenth shaft 250. The rear end of the bottom side rod is fixedly connected to the bottom rear rod 13. The backing plate 14 is provided below the bottom rear rod. The backing plate is fixedly connected to the bottom side rods on both sides, and the backing plate makes the bottom side rods in a horizontal state. The middle part of the bottom rear rod is hinged with the push rod motor 3. A telescopic end of the push rod motor is hinged with the drive rod 4. The drive rod is configured to drive the leg extension mechanism to move. The leg extension mechanism includes the footrest mounting plate 221. The footrest mounting plate is pivotally connected to the first leg link rod 222 through the eleventh shaft 251. The first leg link rod is pivotally connected to the third leg link rod 223 through the twelfth shaft 252. The middle part of the third leg link rod is fixedly connected to the drive rod. The third leg link rod is pivotally connected to the front part of the mounting side plate through the thirteenth shaft 253. The footrest mounting plate is pivotally connected to the second leg link rod 224 through the fourteenth shaft 254. The second leg link rod is pivotally connected to the fourth leg link rod 225 through the fifteenth shaft 255. The fourth leg link rod is pivotally connected to the front part of the mounting side plate through the sixteenth shaft 256. The second leg link rod is pivotally connected to the third leg link rod through the twentieth shaft 260. The backrest mechanism includes the backrest mounting plate 231. The backrest mounting plate is pivotally connected to the rear part of the mounting side plate through the seventeenth shaft 257. The backrest mounting plate is pivotally connected to the rear support link rod 232 through the eighteenth shaft 258. The rear support link rod is pivotally connected to the rear rotating member through the nineteenth shaft 259. The front support member 5 is fixedly connected between the front mounting members on both sides. The rear support member 6 is fixedly connected between the rear mounting members on both sides. The rear support member is provided with the notch 61 for avoiding the push rod motor, so as to avoid movement interference between the push rod motor and the rear support member.

The specific working process and principle of the present invention are as follows.

In a sitting posture, the leg extension mechanism, the base plate linkage mechanism and the backrest mechanism are respectively in a contraction state, four limit pins are in a working state, and one limit pin is in an idle state. That is, the first limit pin 261 abuts against the first limit surface 271; the second limit pin 262 simultaneously abuts against the second limit surface 272 and the third limit surface 273; the third limit pin 263 abuts against the fourth limit surface 274; the fourth limit pin 264 abuts against the sixth limit surface 276; and the fifth limit pin 265 is in an idle state.

When the sitting posture is adjusted to be a TV-watching posture, the push rod motor is activated. Under the action of the drive rod, the leg extension mechanism is in a fully expanded state, and the base plate linkage mechanism and the backrest mechanism maintains in a contraction state. That is, the second limit surface continues to abut against the second limit pin; the third limit surface is separated from the second limit pin; the fourth limit surface is separated from the third limit pin; and the fifth limit surface 275 abuts against the third limit pin. In this way, the leg extension mechanism is maintained in a fully expanded state.

When the TV-watching posture is adjusted to be a lying posture, the push rod motor continues to be activated. Under the action of the drive rod, the leg extension mechanism, the base plate linkage mechanism and the backrest mechanism are all in an expanded state. That is, the first limit surface is separated from the first limit pin; the second limit surface and the third limit surface are simultaneously separated from the second limit pin; the fifth limit surface abuts against the third limit pin; the fifth limit surface is separated from the fourth limit pin; and the seventh limit surface 277 abuts against the fifth limit pin.

In the present invention, the second front rotating member is pivotally connected to the mounting side plate, so that the front part of the mounting side plate is restricted by the second front rotating member. In this way, the mounting side plate is raised more smoothly, thereby improving the user experience.

What is claimed is:

1. A freestanding single-motor-driven mechanical extension device, comprising a base, wherein left and right sides of the base are respectively pivotally connected to an extension assembly;

the extension assembly comprises a base plate linkage mechanism pivotally connected to the base;

a front part of the base plate linkage mechanism is pivotally connected to a leg extension mechanism;

a rear part of the base plate linkage mechanism is pivotally connected to a backrest mechanism;

the base plate linkage mechanism comprises a front mounting member and a rear mounting member;

a first end of the front mounting member is pivotally connected to a front part of the base;

a second end of the front mounting member is pivotally connected to a first end of a first front rotating member;

a second end of the first front rotating member is pivotally connected to a mounting side plate;

a middle part of the front mounting member is pivotally connected to a first end of a second front rotating member;

a second end of the second front rotating member is pivotally connected to a middle part of the mounting side plate;

a first end of the rear mounting member is pivotally connected to a rear part of the base;

a second end of the rear mounting member is pivotally connected to a first end of a rear rotating member;

a second end of the rear rotating member is pivotally connected to a rear part of the mounting side plate;

a middle part of the rear rotating member is pivotally connected to a first end of a side link member; and a second end of the side link member is pivotally connected to the first front rotating member.

2. The freestanding single-motor-driven mechanical extension device according to claim 1, wherein the base comprises a bottom front rod;

two ends of the bottom front rod are respectively fixedly connected to a first end of a bottom side rod;

the bottom side rod is pivotally connected to the extension assembly;

a second end of the bottom side rod is fixedly connected to a bottom rear rod;

a middle part of the bottom rear rod is hinged with a push rod motor;

a telescopic end of the push rod motor is hinged with a drive rod; and the drive rod is configured to drive the leg extension mechanism to move.

3. The freestanding single-motor-driven mechanical extension device according to claim 2, wherein a backing plate is provided below the bottom rear rod, and the backing plate is fixedly connected to bottom side rods on both sides.

4. The freestanding single-motor-driven mechanical extension device according to claim 2, wherein the leg extension mechanism comprises a footrest mounting plate;

the footrest mounting plate is pivotally connected to a first end of a first leg link rod and a first end of a second leg link rod;

a second end of the first leg link rod is pivotally connected to a first end of a third leg link rod;

a middle part of the third leg link rod is fixedly connected to the drive rod;

a second end of the second leg link rod is pivotally connected to a first end of a fourth leg link rod;

a second end of the fourth leg link rod and a second end of the third leg link rod are simultaneously pivotally connected to a front part of the mounting side plate; and a middle part of the second leg link rod is pivotally connected to a middle part of the third leg link rod.

5. The freestanding single-motor-driven mechanical extension device according to claim 1, wherein the backrest mechanism comprises a backrest mounting plate, wherein a first end of the backrest mounting plate is pivotally connected to the mounting side plate;

a second end of the backrest mounting plate is pivotally connected to a first end of a rear support link rod; and a second end of the rear support link rod is pivotally connected to the rear rotating member.

6. The freestanding single-motor-driven mechanical extension device according to claim 1, wherein a front support member is fixedly connected between front mounting members on both sides;

a rear support member is fixedly connected between rear mounting members on both sides; and the rear support member is provided with a notch for avoiding the push rod motor.

7. The freestanding single-motor-driven mechanical extension device according to claim 1, wherein a protective member is fixedly connected to the rear part of the mounting side plate.

* * * * *